US011703248B2

(12) United States Patent
Kulandaisamy et al.

(10) Patent No.: US 11,703,248 B2
(45) **Date of Patent: *Jul. 18, 2023**

(54) PROACTIVE SYSTEM CONTROL USING HUMIDITY PREDICTION

(71) Applicant: Lennox Industries Inc., Richardson, TX (US)

(72) Inventors: Leema Kulandaisamy, Trichy (IN); Rohini Brahme, Irving, TX (US); Santhosh Kumar Selvam, Palakkad (IN); Alwin Sebastian John, Ponkunnam (IN)

(73) Assignee: Lennox Industries Inc., Richardson, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/930,271

(22) Filed: Sep. 7, 2022

(65) Prior Publication Data

US 2023/0003413 A1 Jan. 5, 2023

Related U.S. Application Data

(63) Continuation of application No. 17/153,669, filed on Jan. 20, 2021, now Pat. No. 11,473,806.

(51) Int. Cl.

| | |
|---|---|
| ***F24F 11/65*** | (2018.01) |
| ***F24F 11/46*** | (2018.01) |
| ***F24F 11/77*** | (2018.01) |
| ***F24F 11/86*** | (2018.01) |
| *F24F 140/60* | (2018.01) |
| *F24F 110/12* | (2018.01) |
| *F24F 110/22* | (2018.01) |
| *F24F 130/10* | (2018.01) |

(52) U.S. Cl.

CPC ..... *F24F 11/65* (2018.01); *F24F 11/46* (2018.01); *F24F 11/77* (2018.01); *F24F 11/86* (2018.01); *F24F 2110/12* (2018.01); *F24F 2110/22* (2018.01); *F24F 2130/10* (2018.01); *F24F 2140/60* (2018.01)

(58) Field of Classification Search

None

See application file for complete search history.

(56) References Cited

U.S. PATENT DOCUMENTS

2013/0179373 A1* 7/2013 Mutchnik ..... G06Q 30/0283 705/412

* cited by examiner

*Primary Examiner* — Nathan L Laughlin

(74) *Attorney, Agent, or Firm* — Baker Botts L.L.P.

(57) ABSTRACT

During an initial period of time, an HVAC controller stores a record of an energy demand of the HVAC system that corresponds to an amount of energy used to operate the HVAC system. For a future time period, an anticipated energy demand of the HVAC system is determined. The controller then recursively determines, for each of a plurality of time points within the future time period, an anticipated indoor humidity value using the anticipated energy demand and the record of the energy demand. The HVAC system is operated based at least in part on the anticipated indoor humidity value.

20 Claims, 5 Drawing Sheets

PROACTIVE SYSTEM CONTROL USING HUMIDITY PREDICTION

CROSS-REFERENCE TO RELATED APPLICATION

This application is a continuation of U.S. patent application Ser. No. 17/153,669 filed Jan. 20, 2021, by Leema Kulandaisamy et al., entitled "PROACTIVE SYSTEM CONTROL USING HUMIDITY PREDICTION," which is incorporated herein by reference.

TECHNICAL FIELD

This disclosure relates generally to heating, ventilation, and air conditioning systems and methods of their use. More particularly, in certain embodiments, this disclosure relates to proactive system control using humidity prediction.

BACKGROUND

Heating, ventilation, and air conditioning (HVAC) systems are used to regulate environmental conditions within an enclosed space. In a cooling mode, air is cooled via heat transfer with refrigerant flowing through the HVAC system and returned to the enclosed space as cooled conditioned air. In a heating mode, air is heated via heat transfer with a heating element and returned to the enclosed space as heated conditioned air.

SUMMARY OF THE DISCLOSURE

To provide comfort to occupants of a space, an HVAC system may be operated to maintain the space near a desired humidity. For example, a humidity sensor may be placed in a conditioned space, and measures of humidity may be used to humidify/dehumidify the space to attempt to achieve a target indoor humidity. This disclosure recognizes that previous approaches to humidity control suffers from disadvantages. For example, in cases where there are changes in outdoor conditions, indoor humidity, and/or heating/cooling demand, there may be long periods of discomfort for occupants before the target humidity can be reached.

This disclosure contemplates an unconventional HVAC system that solves problems of conventional systems, including those described above by providing systems, methods, and devices for determining an anticipated indoor humidity and proactively adjusting operation of the HVAC system based on this information. The HVAC system, in certain embodiments, includes a controller that monitors indoor humidity values at different energy demands (e.g., for cooling and/or heating by the HVAC system) and stores a record of this information. During future times, this record of humidity values as a function of energy demand is used along with weather data to recursively determine a set of anticipated indoor humidity values. The HVAC system may then be operated proactively to dehumidify/humidify a space based on anticipated values of indoor humidity. This disclosure presents several technical advantages that improve the operation of an HVAC system. For example, by anticipating future indoor humidity values, humidification or dehumidification can be provided before an anticipated change in conditions, such that time periods during which the conditioned space is uncomfortable for occupants is greatly reduced or eliminated. The HVAC system may also be operated more efficiently by proactively adjusting operation based on anticipated humidity values rather than reactively adjusting operation based on measured humidity values. Certain embodiments may include none, some, or all of the above technical advantages. One or more other technical advantages may be readily apparent to one skilled in the art from the figures, descriptions, and claims included herein.

In an embodiment, an HVAC system includes an indoor humidity sensor positioned and configured to measure an indoor humidity value of air an enclosed space, an outdoor humidity sensor positioned and configured to measure an outdoor humidity value of outdoor air, and a controller communicatively coupled to the indoor humidity sensor and the outdoor humidity sensor. During an initial period of time, the controller receives the indoor humidity value measured by the indoor humidity sensor and the outdoor humidity value measured by the outdoor humidity sensor. The controller stores a record of an energy demand of the HVAC system for each received indoor humidity value and outdoor humidity value. The energy demand of the HVAC system corresponds to an amount of energy used to operate the HVAC system. For a first time point of a future time period that occurs after the initial period of time, a first indoor humidity value and a first outdoor humidity value are received. For the future time period, an anticipated energy demand of the HVAC system is determined based at least in part on the first indoor humidity value, the first outdoor humidity value, and the record of the energy demand during the initial period of time. The controller then recursively determines, for each of a plurality of time points within the future time period following the first time point, an anticipated indoor humidity value using the anticipated energy demand for the future time period. The HVAC system is operated based at least in part on the anticipated indoor humidity value.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1 through 4 of the drawings, like numerals being used for like and corresponding parts of the various drawings.

As described above, prior to this disclosure, humidity control tended to be inefficient and provided insufficient comfort to occupants of a conditioned space. For example, previous technology may have a slow response to changes in indoor humidity, such that a conditioned space may reach an uncomfortable humidity level before the HVAC system is able to adjust operation of a humidifier or dehumidifier to reach a comfortable humidity level. This disclosure recognizes these problems and facilitates the determination of anticipated indoor humidity values. The HVAC system may be proactively operated to provide dehumidification or humidification, such that a conditioned space can efficiently be maintained in a preferred humidity range for occupant comfort (e.g., within a threshold range of a humidity setpoint).

HVAC System

Figure 1:
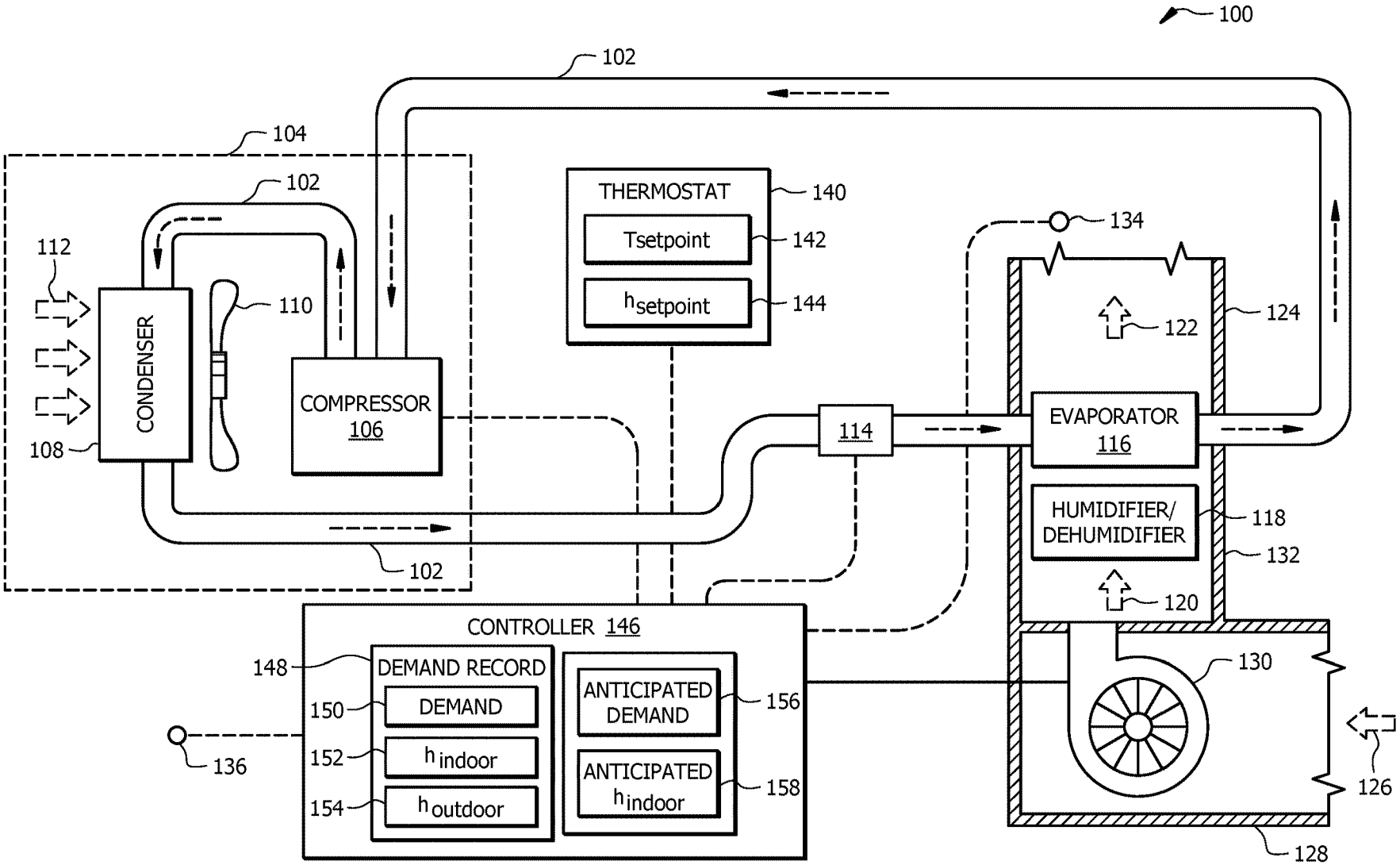
FIG. 1 is a diagram of an example HVAC system configured for proactive operation based on anticipated indoor humidity values.

FIG. 1 is a schematic diagram of an embodiment of an HVAC system 100 with a controller 146 configured to determine anticipated indoor humidity values 158 and appropriate adjust operation of the HVAC system 100 to proactively maintain a conditioned space at or near a humidity setpoint 144. The HVAC system 100 conditions air for delivery to a conditioned space. The conditioned space may be, for example, a room, a house, an office building, a warehouse, or the like. In some embodiments, the HVAC system 100 is a rooftop unit (RTU) that is positioned on the roof of a building and the conditioned air is delivered to the interior of the building. In other embodiments, portion(s) of the system 100 may be located within the building and portion(s) outside the building. The HVAC system 100 may include one or more heating elements, not shown for convenience and clarity. The HVAC system 100 may be configured as shown in FIG. 1 or in any other suitable configuration. For example, the HVAC system 100 may include additional components or may omit one or more components shown in FIG. 1.

The HVAC system 100 includes a working-fluid conduit subsystem 102, at least one condensing unit 104, an expansion valve 114, an evaporator 116, a dehumidifier and/or humidifier 118, a blower 130, one or more thermostats 140, and a controller 146. The working-fluid conduit subsystem 102 facilitates the movement of a working fluid (e.g., a refrigerant) through a cooling cycle such that the working fluid flows as illustrated by the dashed arrows in FIG. 1. The working fluid may be any acceptable working fluid including, but not limited to hydroflurocarbons (e.g. R-410A) or any other suitable type of refrigerant.

The condensing unit 104 includes a compressor 106, a condenser 108, and a fan 110. In some embodiments, the condensing unit 104 is an outdoor unit while other components of system 100 may be located indoors. The compressor 106 is coupled to the working-fluid conduit subsystem 102 and compresses (i.e., increases the pressure of) the working fluid. The compressor 106 of condensing unit 104 may be a single-stage compressor, a variable-speed compressor, or a multi-stage compressor. A variable-speed compressor is generally configured to operate at different speeds to increase the pressure of the working fluid to keep the working fluid moving along the working-fluid conduit subsystem 102. If compressor 106 is a variable-speed compressor, the speed of the compressor 106 can be modified to adjust the cooling capacity of the HVAC system 100 and/or the amount of moisture removed from air 120 passing across the evaporator 116, described further below. In the multi-stage compressor configuration, one or more compressors can be turned on or off to adjust the cooling capacity and/or dehumidification capacity of the HVAC system 100.

The compressor 106 is in signal communication with the controller 146 using wired and/or wireless connection. The controller 146 provides commands and/or signals to control operation of the compressor 106 and/or receives signals from the compressor 106 corresponding to a status of the compressor 106. For example, when the compressor 106 is a variable-speed compressor, the controller 146 may provide signals to control compressor speed. When the compressor 106 operates as a multi-stage compressor, the signals may correspond to an indication of which compressors to turn on and off to adjust the compressor 106 for a given cooling and/or dehumidification capacity. The controller 146 may operate the compressor 106 in different modes corresponding to load conditions (e.g., the amount of cooling or heating requested from the HVAC system 100). The controller 146 is described in greater detail below and with respect to FIG. 4.

The condenser 108 is configured to facilitate movement of the working fluid through the working-fluid conduit subsystem 102. The condenser 108 is generally located downstream of the compressor 106 and is configured to remove heat from the working fluid. The fan 110 is configured to move air 112 across the condenser 108. For example, the fan 110 may be configured to blow outside air through the condenser 108 to help cool the working fluid flowing therethrough. The fan 110 may be in communication with the controller 146 (e.g., via wired and/or wireless communication) to receive control signals for turning the fan 110 on and off and/or adjusting a speed of the fan 110. The compressed, cooled working fluid flows from the condenser 108 toward the expansion device 114.

The expansion device 114 is coupled to the working-fluid conduit subsystem 102 downstream of the condenser 108 and is configured to remove pressure from the working fluid. In this way, the working fluid is delivered to the evaporator 116 and/or the humidifier/dehumidifier 118. In general, the expansion device 114 may be a valve such as an expansion valve or a flow control valve (e.g., a thermostatic expansion valve (TXV)) or any other suitable valve for removing pressure from the working fluid while, optionally, providing control of the rate of flow of the working fluid. The expansion device 114 may be in communication with the controller 146 (e.g., via wired and/or wireless communication) to receive control signals for opening and/or closing associated valves and/or to provide flow measurement signals corresponding to the rate of working fluid flow through the working-fluid conduit subsystem 102.

The evaporator 116 is generally any heat exchanger configured to provide heat transfer between air flowing through (or across) the evaporator 116 (i.e., air 120 contacting an outer surface of one or more coils of the evaporator 116) and working fluid passing through the interior of the evaporator 116. The evaporator 116 may include one or more circuits of coils. The evaporator 116 is fluidically connected to the compressor 106, such that working fluid generally flows from the evaporator 116 to the condensing unit 104 when the HVAC system 100 is operating to provide cooling and/or dehumidification.

The humidifier and/or dehumidifier 118 may include one or more devices operable to add moisture to or remove moisture from the air 120. For example, a humidifier 118 may be any humidification unit, such as a drum style humidifier, a disc wheel humidifier, a spray mist humidifier, or the like. The controller 146 may provide signals instructing the humidifier 118 to operate based on the anticipated humidity values 158, as described in greater detail below. For example, the controller 146 may determine that the anticipated humidity 158 is soon to fall at least a threshold amount below a humidity setpoint 144 and, in response to this determination, cause the humidifier 118 to activate to begin increasing the humidity of air 122.

A dehumidifier 118 may be any dehumidification unit, such as a heat pump dehumidifier or the like. For example, the controller 146 may determine that the anticipated humidity 158 is soon to increase at least a threshold amount above the humidity setpoint 144 and, in response to this determination, cause the dehumidifier 118 to activate to begin decreasing the humidity of air 122. Dehumidification may also or alternatively be provided by the evaporator 116. For example, in response to an appropriate anticipated humidity value (e.g., that is greater than a threshold value), operation of the HVAC system 100 may be adjusted to provide dehumidification via the evaporator 116.

For example, the sensible heat ratio ("S/T ratio") of the HVAC system 100 may be adjusted to increase the amount of latent heat removal (i.e., for dehumidification). The extent of cooling and dehumidification the HVAC system 100 can achieve is generally determined by its sensible capacity (Sc) and latent capacity (Lc). The HVAC system 100 generally has a total capacity (Tc), which is the sum of the sensible capacity and latent capacity (i.e., Tc=Sc+Lc). Generally, sensible capacity refers to an ability of the HVAC system 100 to remove sensible heat from air 120 (i.e., to cool the air). As used herein, sensible heat refers to heat that, when added to or removed from the air 120, results in a temperature change of the air 120. Comparatively, latent heat refers to the ability of an HVAC system 100 to remove latent heat from the air 120 (i.e., to dehumidify the air 120). As used herein, latent heat refers to heat that, when added to or removed from the air 120, results in a phase change of, for example, water within the air 120. The S/T ratio generally changes proportionally with the ratio of the flow rate of air 120 provided by the blower 130 to the tonnage of the HVAC system, which is determined in part by the speed of the compressor 106. As such, the controller 146 may provide instructions to adjust these properties to achieve an appropriate S/T ratio for dehumidification based an anticipated humidity value 158. For example, the S/T ratio may be decreased to increase dehumidification of the air 120 contacting the evaporator 116. Likewise, the S/T ratio may be increased to allow the humidifier 118 to more effectively humidify the air 120.

A portion of the HVAC system 100 is configured to move airflow 120 provided by the blower 130 across the evaporator 116 and/or humidifier/dehumidifier 118 and out of the duct sub-system 124 as conditioned airflow 122. Return air 126, which may be air returning from the building, fresh air from outside, or some combination, is pulled into a return duct 128. A suction side of the blower 130 pulls the return air 126. The blower 130 discharges airflow 120 into a duct 132 such that airflow 120 crosses the evaporator 116, heating elements (not shown), and/or the humidifier/dehumidifier 118 to produce conditioned airflow 120. The blower 130 is any mechanism for providing airflow 120 through the HVAC system 100. For example, the blower 130 may be a constant-speed or variable-speed circulation blower or fan. Examples of a variable-speed blower include, but are not limited to, belt-drive blowers controlled by inverters, direct-drive blowers with electronic commuted motors (ECM), or any other suitable type of blower.

The HVAC system 100 includes one or more sensors 134, 136 in signal communication with controller 146 (e.g., via wired and/or wireless connection). Sensor 134 is positioned and configured to measure a humidity value 152 of the conditioned space. Sensor 136 is positioned and configured to measure a humidity value 155 of the outdoor environment. The humidity values 152, 154 may be relative humidity values, humidity ratios, or any other appropriate measures of humidity in the conditioned space and the outdoor environment. A relative humidity refers to the amount of water vapor in air as a percentage of the total capacity for water vapor in the air at a given temperature. A humidity ratio refers to the ratio of the weight of water vapor in a volume of air divided by the weight of dry air in the same volume. The HVAC system 100 may include one or more further sensors (not shown for conciseness), such as sensors for measuring air temperature, and/or any other properties of a conditioned space (e.g. a room of the conditioned space). Sensors may be positioned anywhere within the conditioned space, the HVAC system 100, and/or the surrounding environment. For example, the HVAC system 100 may include sensors positioned and configured to measure any other suitable type of air temperature (e.g., the temperature of air at one or more locations within the conditioned space and/or an outdoor air temperature) or other property.

The HVAC system 100 includes one or more thermostats 140, for example, located within the conditioned space (e.g. a room or building). The thermostat 140 is generally in signal communication with the controller 146 using any suitable type of wired and/or wireless connection. One or more functions of the controller 146 described further below may be performed by the thermostat 140. For example, the thermostat 140 may include the controller 146. The thermostat 140 may be a single-stage thermostat, a multi-stage thermostat, or any suitable type of thermostat. The thermostat 140 is configured to allow a user to input a desired temperature or temperature setpoint 142 for the conditioned space and/or for a designated space or zone such as a room in the conditioned space and a humidity setpoint 144 for the conditioned space and/or for a designated space or zone. The thermostat 140 may include a temperature sensor and/or humidity sensor. For example, the humidity sensor 134 may be integrated within the thermostat 140. The controller 146 may use information from the thermostat 140 such as the temperature setpoint 142 and/or humidity setpoint 144 for controlling the compressor 10, humidifier/dehumidifier 118, and/or blower 130.

In some embodiments, the thermostat 140 includes a user interface and display for displaying information related to the operation and/or status of the HVAC system 100. For example, the user interface may display operational, diagnostic, and/or status messages and provide a visual interface that allows at least one of an installer, a user, a support entity, and a service provider to perform actions with respect to the HVAC system 100. For example, the user interface may provide for display of messages related to the status and/or operation of the HVAC system 100. The thermostat 140 may be operable to receive information associated with the outdoor weather conditions, such as the weather forecast and/or record 412 described with respect to FIG. 4 below.

As described in greater detail below with respect to the method of FIG. 2, the controller 146 is configured to monitor the demand 150 of the HVAC system 100 over an initial period of time while recording measurements of indoor humidity 152 (from sensor 134) and outdoor humidity 154 (from sensor 136). The demand 150 may be the energy demand of the HVAC system 100. For example, the demand 150 may be the amount of energy consumed by the HVAC system 100 to meet the cooling or heating demand at each combination of indoor humidity value 152 and outdoor humidity value 154. The demand 150 may correspond to an amount of heat transfer performed by the HVAC system 100 (e.g., in units of Btu/hr) at each combination of indoor humidity value 152 and outdoor humidity value 154. The controller 146 uses this information to create and store a demand record 148. The demand record 148 is a record of the demand 150 of the HVAC system for each received indoor humidity value 152 and outdoor humidity value 154 during the initial period of time.

The controller 146 uses the demand record 148 to determine an anticipated future demand 156. For example, based on a currently measured indoor humidity value 152 and outdoor humidity value 154, the controller may use the record 148 to identify a corresponding anticipated demand 156. This anticipated demand 156 generally corresponds to an amount of energy predicted to be consumed by the HVAC system 100 during a future time period after the initial time period during which the demand record 148 was established. For a number of time points during this subsequent time period, the controller then determines anticipated indoor humidity values 158. The anticipated indoor humidity values 158 are determined recursively, such that the anticipated humidity value 158 for a given time point is determined using the anticipated humidity value 158 from the previous time point, as described in greater detail with respect to FIG. 2 below (see the recursive loop 212 of FIG. 2).

The controller 146 then causes the HVAC system 100 to operate based at least in part on the anticipated indoor humidity values 158. For example, the controller 146 may compare the anticipated indoor humidity values 158 to the indoor humidity setpoint 144 to determine if humidification or dehumidification is needed. For instance, if the anticipated indoor humidity value 158 is a threshold value away from the setpoint 144, dehumidification or humidification may be needed. For instance, if the anticipated indoor humidity value 158 is less than a threshold amount less than the humidity setpoint 144, the controller 146 may determine that proactive humidification is needed, and the controller 146 may cause the humidifier 118 to begin humidifying the air 120. The amount of humidification provided by the humidifier 118 may be determined using the difference between the anticipated indoor humidity value 158 and the humidity setpoint 144, such that the amount of humidification provided is increased as this difference increases.

As another example, if the anticipated indoor humidity value 158 is greater than a threshold amount above than the humidity setpoint 144, the controller 146 may determine that proactive dehumidification is needed, and the controller 146 may cause the dehumidifier 118 to begin dehumidifying the air 120 and/or adjust operation of the compressor 106 and/or blower 130 to decrease the S/T ratio of the HVAC system 100. The amount of dehumidification provided by the dehumidifier 118 and/or the evaporator 116 may be determined using the difference between the anticipated indoor humidity value 158 and the humidity setpoint 144, such that the amount of dehumidification provided is increased when this difference increases.

In some embodiments, the controller 146 may adjust operation of other components of the HVAC system 100 to respond more effectively to anticipated humidity values 158 being outside a threshold range from the humidity setpoint 144. For example, the S/T ratio of the HVAC system 100 may be adjusted to more effectively maintain the humidity 152 of the conditioned space at or near the humidity setpoint 144. For example, the speed of the blower 130 and/or the compressor 106 may be adjusted to decrease the S/T ratio such that evaporator 116 more effectively dehumidifies the air 120 or increase the S/T ratio such that the air 120 can be more efficiently humidified by the humidifier 118 when cooling is being provided by the evaporator 116 (e.g., to reduce the amount of moisture removed from the air 120 by the evaporator 116).

As described above, in certain embodiments, connections between various components of the HVAC system 100 are wired. For example, conventional cable and contacts may be used to couple the controller 146 to the various components of the HVAC system 100, including, the compressor 106, the expansion valve 114, the blower 130, sensor(s) 134, 136, and thermostat(s) 140. In some embodiments, a wireless connection is employed to provide at least some of the connections between components of the HVAC system 100. In some embodiments, a data bus couples various components of the HVAC system 100 together such that data is communicated there between. In a typical embodiment, the data bus may include, for example, any combination of hardware, software embedded in a computer readable medium, or encoded logic incorporated in hardware or otherwise stored (e.g., firmware) to couple components of HVAC system 100 to each other. As an example and not by way of limitation, the data bus may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus may include any number, type, or configuration of data buses, where appropriate. In certain embodiments, one or more data buses (which may each include an address bus and a data bus) may couple the controller 146 to other components of the HVAC system 100.

In an example operation of the HVAC system 100, the HVAC system 100 is operating to provide cooling or heating to a space. During an initial time, the controller stores the demand record 148 which includes the demand 150 of the HVAC system 100 at measured indoor humidity values 152 and outdoor humidity values 154. This demand record 148 is used to generate an ordinary least square (piecewise OLS) model (e.g., the piecewise OLS model 414 of FIG. 4), which is used for the recursive determination of anticipated indoor humidity values 158. Once the demand record 148 is established, the controller 146 begins to operate in a proactive humidity control mode in which operation is adjusted based on the anticipated indoor humidity values 158.

The controller 146 may use a current indoor humidity value 152 and outdoor humidity value to determine an anticipated demand 156 for the next period of time (e.g., for the next 15 minutes or any other appropriate period of time). The anticipated demand 156 may be determined using the current operating mode (i.e., whether cooling or heating is being provided) and/or the current indoor humidity value 152 and outdoor humidity value 154. For instance, if the HVAC system 100 is currently operating in a cooling mode, the anticipated demand 156 may be determined as a slightly higher value (e.g., 5%, 10%, or any other appropriate amount higher) than the current demand 150 of the HVAC system 100 at the current indoor humidity value 152 and outdoor humidity value 154. Alternatively, if the HVAC system 100 is currently operating in a heating mode, the anticipated demand 156 may be determined as the same value as the current demand 150 of the HVAC system 100 at the current indoor humidity value 152 and outdoor humidity value 154. In some embodiments, weather forecast information (e.g., the weather forecast and/or record of FIG. 4) may be used to refine the determination of the anticipated demand 156. For example, if a forecast indicates an upcoming change in temperature and/or humidity or a weather event (e.g., rain, snow, wind, or the like), this information may be used to further improve the determination of the anticipated demand 156. For example, if a sudden decrease in temperature is expected, the anticipated demand 156 for cooling mode operation may be decreased, while the anticipated demand 156 for heating mode operation may be increased. Similarly, if the current date has historically had particular temperature or humidity characteristics based on historical records, the anticipated demand 156 may be adjusted based on an expectation of similar conditions. For example, the demand 156 for cooling mode operation may be decreased if the current date historically experiences relatively low temperatures.

A set of anticipated indoor humidity values 158 are then determined during this next time period. The anticipated indoor humidity values 158 are determined recursively as illustrated by the loop 212 of FIG. 2, which is described in greater detail below. In brief, the controller 146 my use the current indoor humidity 152 for an initial time point and then recursively determine (e.g., using the piecewise OLS model 414 of FIG. 4) how the indoor humidity 152 is likely to change during the next time period. Examples of resulting anticipated indoor humidity values 158 are illustrated in the examples of FIGS. 3A and 3B, described below. The anticipated indoor humidity values 158 are then used to proactively provide humidification if the anticipated indoor humidity values 158 drop more than a threshold amount below the humidity setpoint 144 or to provide dehumidification if the anticipated indoor humidity values 158 increase more than a threshold amount above the humidity setpoint 144.

Example Method of Operation

Figure 2:
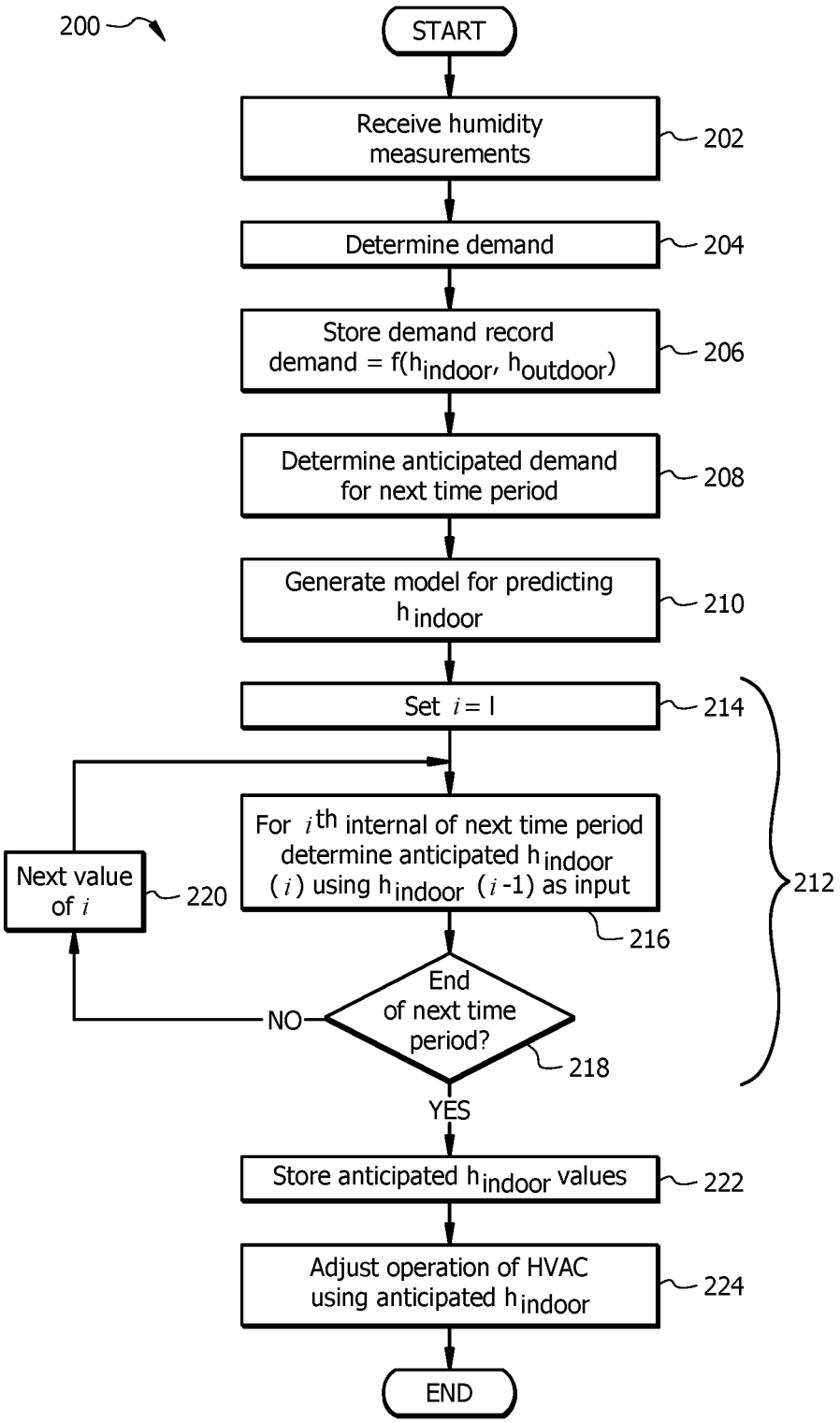
FIG. 2 is a flowchart illustrating an example method of operating the HVAC system of FIG. 1.
Figure 3A:
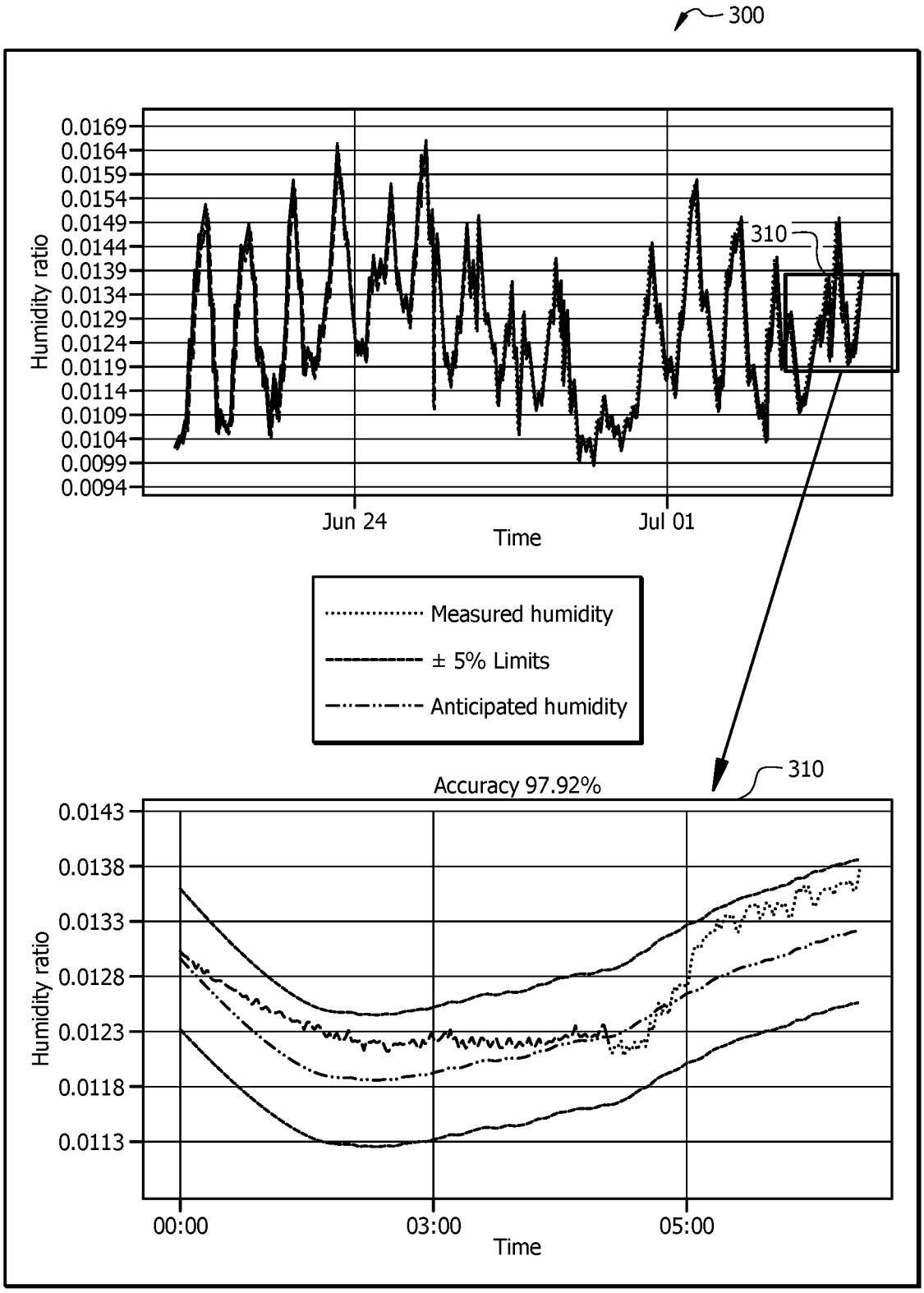
FIGS. 3A and 3B are plots of example measured humidity values and humidity values predicted using the approach of this disclosure, according to an illustrative embodiment.
Figure 3B:
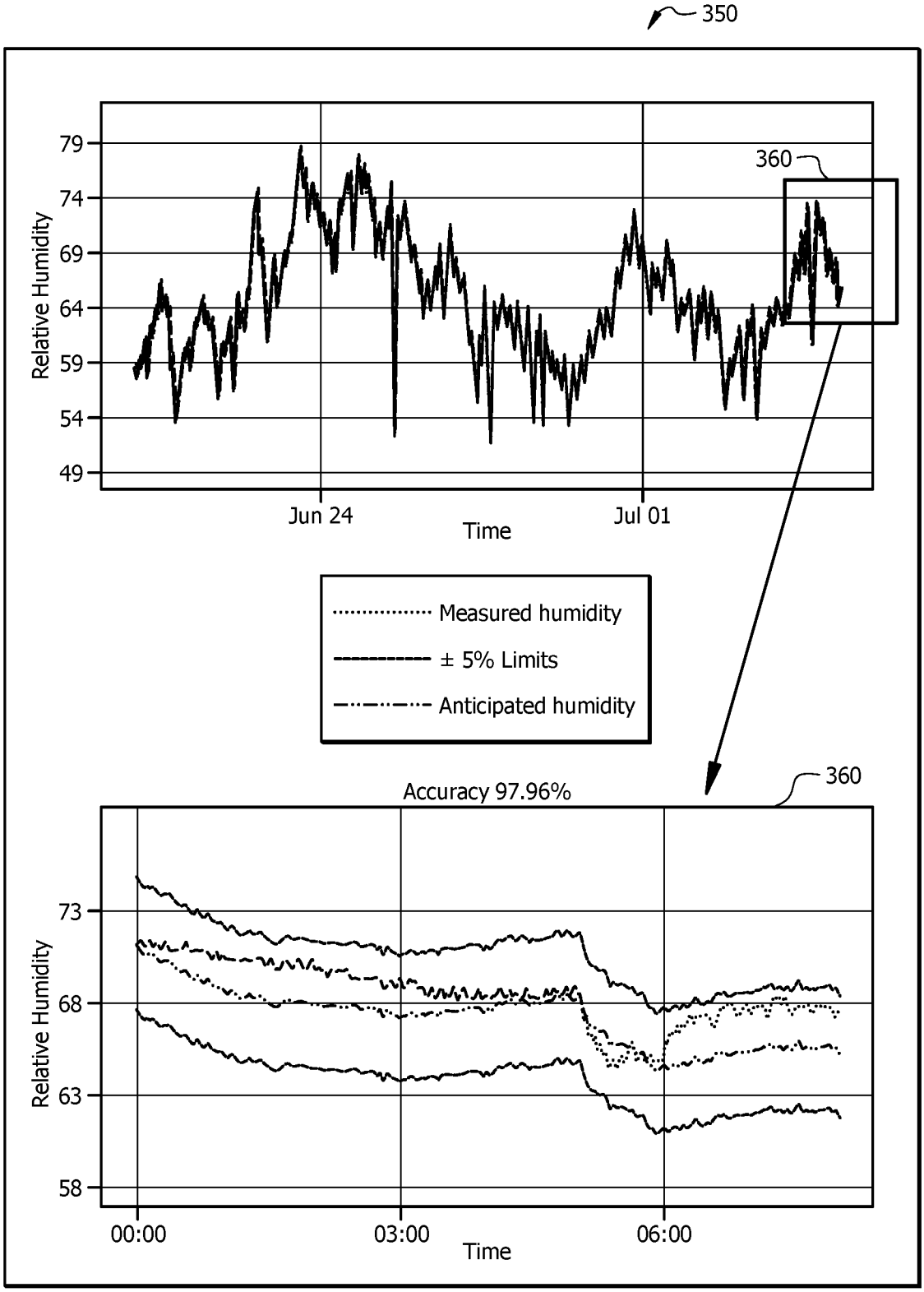

FIG. 2 is a flowchart of a method 200 for the proactive control of the HVAC system 100 of FIG. 1 based on anticipated indoor humidity values 158. The method 200 may begin at step 202 where measurements of indoor humidity 152 and outdoor humidity 154 are received. The measures of indoor humidity 152 may be received from sensor 134, described above with respect to FIG. 1. The measures of outdoor humidity 154 may be received from sensor 136, described above with respect to FIG. 1. In some embodiments, measures of outdoor humidity 154 may be determined from a record of weather conditions (e.g., from the weather forecast and/or record 412 of FIG. 4).

At step 204, the demand 150 of the HVAC system 100 is determined. The demand 150 may be the amount of power supplied to the compressor 106, blower 130, and/or other components of the HVAC system 100 to satisfy the air conditioning needs (e.g., to maintain at or near a setpoint temperature 142) at each combination of indoor humidity 152 and outdoor humidity 154. In some cases, the demand 150 may be an amount of heat transfer performed by the HVAC system 100 (e.g., in units of Btu/hr) at each combination of indoor humidity value 152 and outdoor humidity value 154.

At step 206, the demand record 148 is generated and stored. The demand record generally includes, for each indoor humidity value 152 and outdoor humidity value 154, a corresponding demand 150. For example, the demand record 148 may be stored as a table or in any other appropriate format. The demand record 148 may store demands 150 as a function of indoor humidity value 152, outdoor humidity value 154, and the operating mode (i.e., whether heating or cooling) of the HVAC system 100.

At step 208, an anticipated demand 156 is determined for a subsequent period of time. For example, a subsequent time may be a future time period (e.g., of 15 minutes, one hour, or any other appropriate period of time) after the current time. The anticipated demand 156 may be the amount of energy anticipated to be required to meet a heating or cooling demand during this subsequent period of time or an amount of heat transfer anticipated to be performed by the HVAC system 100 during the subsequent period of time. The anticipated demand 156 is generally determined using the current indoor humidity value 152, outdoor humidity value 154, and/or operating mode of the HVAC system 100. For example, the anticipated demand 156 may be a previously stored demand 150 for stored indoor and outdoor humidity values 152, 154 that are the same as or similar to the current indoor and outdoor humidity values 152, 154.

In some embodiments, the anticipated demand 156 is based on the current or a recent demand 150 of the HVAC system 100. For instance, if the HVAC system 100 is currently operating in a cooling mode, the anticipated demand 156 may be determined as a slightly higher value than the current demand 150 of the HVAC system 100 at the current indoor humidity value 152 and outdoor humidity value 154. Alternatively, if the HVAC system 100 is currently operating in a heating mode, the anticipated demand 156 may be determined as the same value as the current demand 150 of the HVAC system 100.

At step 210, a model (e.g., the piecewise OLS model 414 of FIG. 4) may be generated for determining anticipated indoor humidity values 158. For example, a piecewise OLS model may be generated by determining one or more parameters to fit a function that expresses the indoor humidity value 152 as a function of the demand 150, outdoor humidity 154, and optionally other properties of the HVAC system 100 and/or the local environment, such as an operating mode of the HVAC system 100, an indoor temperature, an outdoor temperature, and the like. As an example, a piecewise OLS model (e.g., piecewise OLS model 414 of FIG. 4) may be a linear regression determined using the demand record 148. As a nonlimiting example, the demand record 148 may include a set of indoor humidity values 152 (y), demands 150 ($x_1$), and outdoor humidity values 154 ($x_2$), and the generated model (e.g., the piecewise OLS model 414 of FIG. 4) may correspond to:

$$y=a+b_1x_1+b_2x_2$$

where a, $b_1$, and $b_2$ are constants determined to fit the demand record 148 to this function. Any appropriate approach to data fitting may be employed to generate the model at step 210.

As a further example, the controller 146 may receive a weather forecast (e.g., forecast 412 of FIG. 4) and use this weather forecast to determine anticipated values of outdoor humidity and outdoor temperature in the future. The piecewise OLS model (e.g., piecewise OLS model 414 of FIG. 4) may be generated at step 210 similarly to as described above using the anticipated demand 156, the anticipated outdoor humidity value(s), and the anticipated outdoor temperature value(s). The resulting piecewise OLs model (e.g., piecewise OLS model 414 of FIG. 4) may be used to recursively determine anticipated indoor humidity values 158 as described below with respect to steps 214-218.

At steps 214-218, the anticipated indoor humidity values 158 are determined recursively using loop 212. At step 214, the recursive iteration number (i) is set to one. The value of i corresponds to a time increment within the period of the future period of time for which the anticipated humidity values 158 are determined. For instance, if a set of anticipated values 158 are determined for a 15 minute time period (e.g., the next time period for which the anticipated demand 156 was determined at step 208), then each value of i corresponds to an incremental time step forward in this time period. For instance, if a 15 minute time period is separated into 30 iteration, then each iteration (i) may correspond to a 30 second time step (e.g., such that i=1 corresponds to 30 seconds in the future, i=2 corresponds to one minute in the future, etc.).

At step 216, the anticipated indoor humidity 158 is determined for the current value of i (e.g., for the current time point in the next time period). For example, the controller 146 may use the piecewise OLS model (e.g., piecewise OLS model 414 of FIG. 4) from step 210 to determine the anticipated indoor humidity 158 using the anticipated indoor humidity value 158 from the previous iteration (i−1) and the anticipated demand 156. For the first iteration (i=1), the anticipated indoor humidity value 158 may be determined using the last measured indoor humidity value 152 as the previous iteration value. In some embodiments, the anticipated indoor humidity 158 (e.g., value y of the equation presented above) may be determined using the model from step 210 (e.g., constants a, $b_1$, and $b_2$) along with the anticipated demand 156 (e.g., value $x_1$) and an anticipated outdoor humidity value (e.g., value $x_2$) In some cases, the anticipated outdoor humidity value (e.g., value $x_2$) is the measured outdoor humidity value 154 from the last available measurement (e.g., before starting the iteration loop 212). In some cases, the controller 146 may use weather forecast information (e.g., information 412 of FIG. 4) to determine an anticipated outdoor humidity value to account for forecasted changes in weather conditions.

At step 218, the controller 146 determines if the entire next time period during which anticipated indoor humidity values 158 were to be determined (e.g., for the anticipated demand 156 from step 208) is complete. For example, the controller 146 may determine if a maximum or final iteration (i) value is reached. If the end of the time period is not reached, the controller 146 repeats the loop 212 by proceeding to the next iteration value (i) at step 220. If the end of the time period is not reached, the controller 146 proceeds to step 222 where the anticipated indoor humidity values 222 are stored. For example, the anticipated humidity values 158 may be stored in a memory (e.g., memory 404 of FIG. 4) of the controller 146.

At step 224, the controller 146 adjusts operation of the HVAC system 100 using the anticipated indoor humidity values 158. As described above, the anticipated humidity values 158 may be used to operate the HVAC system 100 to more efficiently the indoor humidity 152 at or near the humidity setpoint 144, for example, by adjusting operation of the humidifier/dehumidifier 118 and/or other components of the HVAC system 100 (e.g., to adjust the S/T ratio of the HVAC system 100). For example, if at least one of the anticipated indoor humidity values 158 is at least a threshold amount above the humidity setpoint 144, the controller 146 may cause the HVAC system to proactively begin providing dehumidification. Dehumidification may be provided by activating the dehumidifier 118 and/or decreasing the S/T ratio of the HVAC system 100. As another example, if at least one of the anticipated indoor humidity values 158 is at least a threshold amount below the humidity setpoint 144, the controller 146 may cause the HVAC system to proactively begin providing humidification. For example, the controller 146 may activate the humidifier 118.

Modifications, additions, or omissions may be made to method 200 depicted in FIG. 2. Method 200 may include more, fewer, or other steps. For example, steps may be performed in parallel or in any suitable order. While at times discussed as the controller 146 performing the steps, any suitable components (e.g., a thermostat 140) of the HVAC system 100 may perform one or more steps of the method.

Example Results of Humidity Value Prediction

FIGS. 3A and 3B show experimental results for HVAC systems configured like HVAC system 100 of FIG. 1 for proactive humidity control using anticipated indoor humidity values 158. FIG. 3A is a plot 300 of measured and anticipated indoor humidity values presented as a humidity ratio. The expanded portion 310 of plot 300 shows the anticipated humidity (dashed-dotted line) compared to humidity values that were subsequently measured (dotted line). The anticipated humidity values were unexpectedly close to the measured values. The cumulative accuracy of the anticipated humidity value was greater than 97% during the time period illustrated in expanded plot 310.

FIG. 3B shows that a similarly accurate anticipated humidity values were obtained for another example system. The plot 350 of FIG. 3B shows measured and anticipated indoor humidity values presented as a relative humidity. The expanded portion 360 of plot 350 shows the anticipated humidity (dashed-dotted line) compared to humidity values that were subsequently measured (dotted line). Similarly to as shown in FIG. 3A, the anticipated humidity values were again unexpectedly close to the measured values. The cumulative accuracy of the anticipated humidity value was greater than 97% during the time period illustrated in expanded plot 360.

Example HVAC Controller

Figure 4:
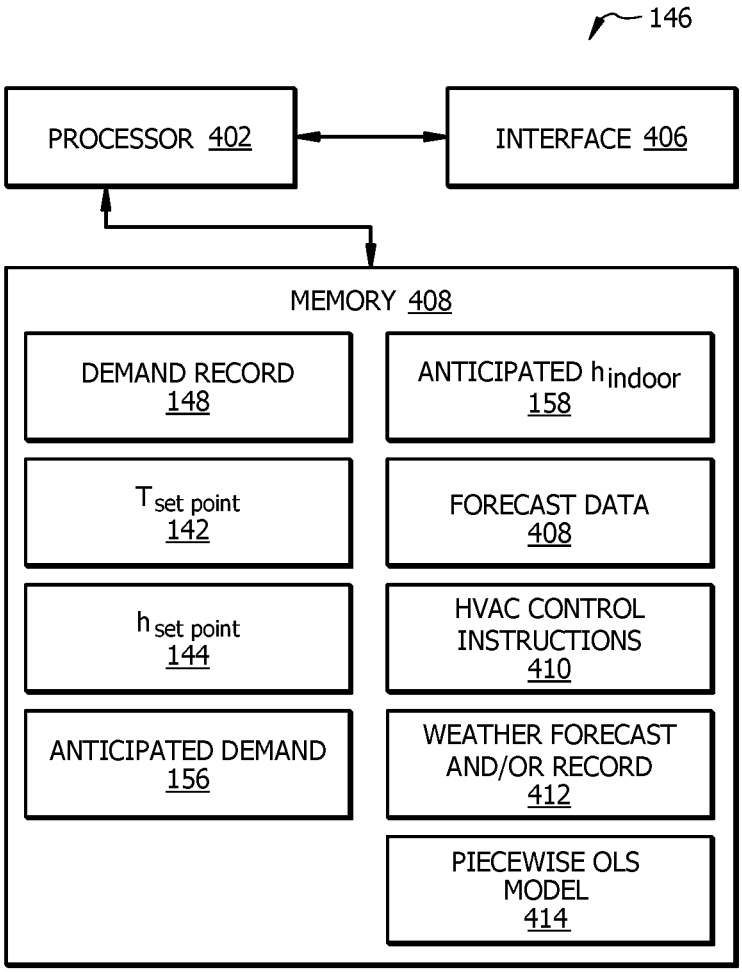
FIG. 4 is a diagram of an example controller of the HVAC system of FIG. 1.

FIG. 4 is a schematic diagram of an embodiment of the controller 146. The controller 146 comprises a processor 402, a memory 404, and an input/output (I/O) interface 406. The processor 402 comprises one or more processors operably coupled to the memory 404.

The processor 402 is any electronic circuitry including, but not limited to, state machines, one or more central processing unit (CPU) chips, logic units, cores (e.g. a multi-core processor), field-programmable gate array (FPGAs), application specific integrated circuits (ASICs), or digital signal processors (DSPs) that communicatively couples to memory 404 and controls the operation of HVAC system 100. The processor 402 may be a programmable logic device, a microcontroller, a microprocessor, or any suitable combination of the preceding. The processor 402 is communicatively coupled to and in signal communication with the memory 404. The one or more processors are configured to process data and may be implemented in hardware or software. For example, the processor 402 may be 8-bit, 16-bit, 32-bit, 64-bit or of any other suitable architecture. The processor 402 may include an arithmetic logic unit (ALU) for performing arithmetic and logic operations, processor registers that supply operands to the ALU and store the results of ALU operations, and a control unit that fetches instructions from memory 404 and executes them by directing the coordinated operations of the ALU, registers, and other components. The processor may include other hardware and software that operates to process information, control the HVAC system 100, and perform any of the functions described herein (e.g., with respect to FIGS. 1 and 2). The processor 402 is not limited to a single processing device and may encompass multiple processing devices. Similarly, the controller 146 is not limited to a single controller but may encompass multiple controllers.

The memory 404 comprises one or more disks, tape drives, or solid-state drives, and may be used as an over-flow data storage device, to store programs when such programs are selected for execution, and to store instructions and data that are read during program execution. The memory 404 may be volatile or non-volatile and may comprise ROM, RAM, ternary content-addressable memory (TCAM), dynamic random-access memory (DRAM), and static random-access memory (SRAM). The memory 404 is operable to store any suitable set of instructions, logic, rules, and/or code for executing the functions described in this disclosure with respect to FIGS. 1 and 2. The memory 404 may store HVAC control instructions 410. For example, the HVAC control instructions 410 may include any instructions, logic, rules, and/or code for adjusting operation of the HVAC system 100 based on the anticipated indoor humidity values 158. For example, the HVAC control instructions 410 may include a threshold value above or below which the controller 146 will instruct the HVAC system 100 to provide dehumidification or humidification, respectively. The memory 404 may store a weather forecast and/or record 412. As described above with respect to FIGS. 1 and 2, the weather forecast and/or record 412 may be used to determine the anticipated demand 156 and/or the anticipated indoor humidity values 158. The memory 404 may store a piecewise OLS model 414, such as the model described above with respect to step 210 of FIG. 2.

The I/O interface 406 is configured to communicate data and signals with other devices. For example, the I/O interface 406 may be configured to communicate electrical signals with the components of the HVAC system 100. The I/O interface may send and/or receive, for example, measures of indoor humidity 152 from sensor 134, measures of outdoor humidity 154 from sensor 136, thermostat calls, temperature setpoint 142, humidity setpoint 146, blower control signals, environmental conditions, and an operating mode status for the HVAC system 100. The I/O interface 406 may use any suitable type communication protocol. For example, the I/O interface 406 may be configured to transmit pulse width modulation (PWM) signals to control various components of the HVAC system 100. The I/O interface 406 may comprise ports or terminals for establishing signal communications between the controller 146 and other devices. The I/O interface 406 may be configured to enable wired and/or wireless communications.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A heating, ventilation, and air conditioning (HVAC) system comprising:

an indoor humidity sensor positioned and configured to measure an indoor humidity value of air in an enclosed space;

an outdoor humidity sensor positioned and configured to measure an outdoor humidity value of outdoor air; and a controller communicatively coupled to the indoor humidity sensor and the outdoor humidity sensor, wherein the controller comprises a processor configured to:

during an initial period of time, store a record of an energy demand of the HVAC system that corresponds to an amount of energy used to operate the HVAC system;

for a first time point of a future time period that occurs after the initial period of time, receive a first indoor humidity value measured by the indoor humidity sensor and a first outdoor humidity value measured by the outdoor humidity sensor;

for the future time period, determine an anticipated energy demand of the HVAC system, based at least in part on the first indoor humidity value, the first outdoor humidity value, and the record of the energy demand during the initial period of time;

recursively determine, for each of a plurality of time points within the future time period following the first time point, an anticipated indoor humidity value using the anticipated energy demand for the future time period; and cause the HVAC system to operate based at least in part on the anticipated indoor humidity value.

2. The HVAC system of claim 1, wherein the indoor humidity value is a humidity ratio.

3. The HVAC system of claim 1, wherein the processor is further configured to determine that the anticipated energy demand of the HVAC system is an increased demand if the HVAC system is operating in a cooling mode during the initial period of time and is an unchanged demand if the HVAC system is operating in a heating mode during the initial period of time.

4. The HVAC system of claim 1, wherein the processor is further configured to:

receive a weather forecast;

determine an anticipated outdoor humidity value using the weather forecast;

determine an anticipated outdoor temperature value using the weather forecast;

recursively determine, for each of the plurality of time points within the future time period following the first time point, the anticipated indoor humidity value using the anticipated energy demand for the future time period, the anticipated outdoor humidity value, and the anticipated outdoor temperature value.

5. The HVAC system of claim 4, wherein the processor is further configured to:

generate a piecewise ordinary least square (OLS) model using the record of an energy demand of the HVAC system for each received indoor humidity value and outdoor humidity value, the anticipated outdoor humidity value, and the anticipated outdoor temperature value; and recursively determine the anticipated indoor humidity value for each of the plurality of time points within the future time period following the first time point using the generated piecewise OLS model.

6. The HVAC system of claim 1, wherein the processor is further configured to cause the HVAC system to operate based on the anticipated indoor humidity value by:

comparing the anticipated indoor humidity value to a setpoint humidity value;

if the anticipated indoor humidity value is a threshold amount above the setpoint humidity value, causing the HVAC system to begin providing dehumidification;

if the anticipated indoor humidity value is a threshold amount below the setpoint humidity value, causing the HVAC system to begin providing humidification; and if the anticipated indoor humidity value is not a threshold amount above or below the setpoint humidity value, allowing the HVAC system to operate in a current operating mode.

7. The HVAC system of claim 6, wherein the processor is further configured to cause the HVAC system to begin providing dehumidification by adjusting one or both of a speed of a compressor of the HVAC system and a speed of a blower of the HVAC system to decrease a sensible heat ratio of the HVAC system.

8. A method of operating a heating, ventilation, and air conditioning (HVAC) system, the method comprising:

during an initial period of time, storing a record of an energy demand of the HVAC system that corresponds to an amount of energy used to operate the HVAC system;

for a first time point of a future time period that occurs after the initial period of time, receiving a first indoor humidity value and a first outdoor humidity value;

for the future time period, determining an anticipated energy demand of the HVAC system, based at least in part on the first indoor humidity value, the first outdoor humidity value, and the record of the energy demand during the initial period of time;

recursively determining, for each of a plurality of time points within the future time period following the first time point, an anticipated indoor humidity value using the anticipated energy demand for the future time period; and causing the HVAC system to operate based at least in part on the anticipated indoor humidity value.

9. The method of claim 8, wherein the indoor humidity value is a humidity ratio.

10. The method of claim 8, further comprising determining that the anticipated energy demand of the HVAC system is an increased demand if the HVAC system is operating in a cooling mode during the initial period of time and is an unchanged demand if the HVAC system is operating in a heating mode during the initial period of time.

11. The method of claim 8, further comprising:

receiving a weather forecast;

determining an anticipated outdoor humidity value using the weather forecast;

determining an anticipated outdoor temperature value using the weather forecast;

recursively determining, for each of the plurality of time points within the future time period following the first time point, the anticipated indoor humidity value using the anticipated energy demand for the future time period, the anticipated outdoor humidity value, and the anticipated outdoor temperature value.

12. The method of claim 11, further comprising:

generating a piecewise ordinary least square (OLS) model using the record of an energy demand of the HVAC system for each received indoor humidity value and outdoor humidity value, the anticipated outdoor humidity value, and the anticipated outdoor temperature value; and recursively determining the anticipated indoor humidity value for each of the plurality of time points within the future time period following the first time point using the generated piecewise OLS model.

13. The method of claim 8, further comprising causing the HVAC system to operate based on the anticipated indoor humidity value by:

comparing the anticipated indoor humidity value to a setpoint humidity value;

if the anticipated indoor humidity value is a threshold amount above the setpoint humidity value, causing the HVAC system to begin providing dehumidification;

if the anticipated indoor humidity value is a threshold amount below the setpoint humidity value, causing the HVAC system to begin providing humidification; and if the anticipated indoor humidity value is not a threshold amount above or below the setpoint humidity value, allowing the HVAC system to operate in a current operating mode.

14. The method of claim 13, further comprising causing the HVAC system to begin providing dehumidification by adjusting one or both of a speed of a compressor of the HVAC system and a speed of a blower of the HVAC system to decrease a sensible heat ratio of the HVAC system.

15. A controller of a heating, ventilation, and air conditioning (HVAC) system, the controller comprising:

an interface configured to communicate with:

an indoor humidity sensor positioned and configured to measure an indoor humidity value of air in an enclosed space;

an outdoor humidity sensor positioned and configured to measure an outdoor humidity value of outdoor air; and a controller operatively coupled to the interface, wherein the processor is configured to:

during an initial period of time, store a record of an energy demand of the HVAC system that corresponds to an amount of energy used to operate the HVAC system;

for a first time point of a future time period that occurs after the initial period of time, receive a first indoor humidity value measured by the indoor humidity sensor and a first outdoor humidity value measured by the outdoor humidity sensor;

for the future time period, determine an anticipated energy demand of the HVAC system, based at least in part on the first indoor humidity value, the first outdoor humidity value, and the record of the energy demand during the initial period of time;

recursively determine, for each of a plurality of time points within the future time period following the first time point, an anticipated indoor humidity value using the anticipated energy demand for the future time period; and cause the HVAC system to operate based at least in part on the anticipated indoor humidity value.

16. The controller of claim 15, wherein the processor is further configured to determine that the anticipated energy demand of the HVAC system is an increased demand if the HVAC system is operating in a cooling mode during the initial period of time and is an unchanged demand if the HVAC system is operating in a heating mode during the initial period of time.

17. The controller of claim 15, wherein the processor is further configured to:

receive a weather forecast;

determine an anticipated outdoor humidity value using the weather forecast;

determine an anticipated outdoor temperature value using the weather forecast;

recursively determine, for each of the plurality of time points within the future time period following the first time point, the anticipated indoor humidity value using the anticipated energy demand for the future time period, the anticipated outdoor humidity value, and the anticipated outdoor temperature value.

18. The controller of claim 17, wherein the processor is further configured to:

generate a piecewise ordinary least square (OLS) model using the record of an energy demand of the HVAC system for each received indoor humidity value and outdoor humidity value, the anticipated outdoor humidity value, and the anticipated outdoor temperature value; and recursively determine the anticipated indoor humidity value for each of the plurality of time points within the future time period following the first time point using the generated piecewise OLS model.

19. The controller of claim 15, wherein the processor is further configured to cause the HVAC system to operate based on the anticipated indoor humidity value by:

comparing the anticipated indoor humidity value to a setpoint humidity value;

if the anticipated indoor humidity value is a threshold amount above the setpoint humidity value, causing the HVAC system to begin providing dehumidification;

if the anticipated indoor humidity value is a threshold amount below the setpoint humidity value, causing the HVAC system to begin providing humidification; and if the anticipated indoor humidity value is not a threshold amount above or below the setpoint humidity value, allowing the HVAC system to operate in a current operating mode.

20. The controller of claim 19, wherein the processor is further configured to cause the HVAC system to begin providing dehumidification by adjusting one or both of a speed of a compressor of the HVAC system and a speed of a blower of the HVAC system to decrease a sensible heat ratio of the HVAC system.

* * * * *